US008578573B2

(12) United States Patent
Hashimoto

(10) Patent No.: US 8,578,573 B2
(45) Date of Patent: Nov. 12, 2013

(54) PIN FASTENER

(75) Inventor: Hisajiro Hashimoto, Aichi (JP)

(73) Assignee: Yugen Kaisha Houseki-No-Angel, Aichi (JP)

( * ) Notice: Subject to any disclaimer, the term of this patent is extended or adjusted under 35 U.S.C. 154(b) by 156 days.

(21) Appl. No.: 13/141,472

(22) PCT Filed: Dec. 11, 2009

(86) PCT No.: PCT/JP2009/071073

§ 371 (c)(1),
(2), (4) Date: Jun. 22, 2011

(87) PCT Pub. No.: WO2010/073967

PCT Pub. Date: Jul. 1, 2010

(65) Prior Publication Data

US 2011/0258816 A1 Oct. 27, 2011

(30) Foreign Application Priority Data

Dec. 24, 2008 (JP) ..... 2008-326904

(51) Int. Cl.
*A44B 1/04* (2006.01)

(52) U.S. Cl.
USPC ..... 24/595.1; 24/574.1; 24/707.3; 63/3.1

(58) Field of Classification Search
USPC ..... 24/574.1, 594.1, 594.11, 595.1, 673, 24/678, 705, 706.2, 706.3, 706.5, 707.2, 24/707.3, 707.4, 707.6, 709, 573.11, 24/596.1, 615, 642, 657, 656, DIG. 35, 24/DIG. 48, DIG. 47, DIG. 51, 573.09, 24/580.1, 581.1, 587.11, 589.1, 590.1, 24/604, 610, 611, 613, 644, 650, 653, 664, 24/707.1, 706.6, DIG. 52; 63/3.1, 3.2
See application file for complete search history.

(56) References Cited

U.S. PATENT DOCUMENTS

| | | | | | |
|---|---|---|---|---|---|
| 698,127 | A | * | 4/1902 | Mitchell | 403/303 |
| 1,061,410 | A | * | 5/1913 | Schmidt et al. | 24/706.6 |
| 1,159,022 | A | * | 11/1915 | Hayashi | 24/706.8 |
| 3,286,316 | A | * | 11/1966 | Marosy | 24/574.1 |
| 4,216,567 | A | | 8/1980 | Heinz | |
| 4,246,679 | A | * | 1/1981 | Monett | 24/587.11 |
| 4,292,715 | A | * | 10/1981 | Huddon | 24/705 |
| 5,138,855 | A | * | 8/1992 | Faris | 70/457 |
| 6,138,333 | A | * | 10/2000 | Hollingworth | 24/705 |
| 6,484,376 | B1 | * | 11/2002 | Khatchadourian et al. | 24/658 |
| 2005/0188512 | A1 | * | 9/2005 | Ninomiya | 24/587.11 |
| 2009/0276989 | A1 | * | 11/2009 | Mongkhonpradit | 24/595.1 |

FOREIGN PATENT DOCUMENTS

| | | | |
|---|---|---|---|
| JP | 52-574 | A | 1/1977 |
| JP | 9-182608 | A | 7/1997 |
| JP | 2000-316616 | A | 11/2000 |
| JP | 2001-321209 | A | 11/2001 |
| JP | 2008-394 | A | 1/2008 |

* cited by examiner

*Primary Examiner* — Robert J Sandy
*Assistant Examiner* — Abigail E Morrell
(74) *Attorney, Agent, or Firm* — McDermott Will & Emery LLP

(57) ABSTRACT

A pin fastener includes a cylindrical body into which a pin is inserted, a coil spring wound on the outer periphery of the cylindrical body, and an outer cylindrical body surrounding the outer periphery of the cylindrical body and coil spring. A cut is provided in the cylindrical body, and a linear fastening portion of the coil spring is fitted into the cut, thereby forming a pin fastening narrowed portion between the fastening portion and a wall portion of the cylindrical body opposed thereto.

12 Claims, 9 Drawing Sheets

(a)

(b)

(a)

(b)

(a)

(b)

(a)

(b)

(a)

(b)

PIN FASTENER

CROSS REFERENCE TO PRIOR APPLICATIONS

This application is a U.S. National Phase application under 35 U.S.C. §371 of International Application No. PCT/W2009/071073, filed on Dec. 11, 2009 and claims benefit of priority to Japanese Patent Application No. 2008-326904, filled on Dec. 24, 2008. The International Application was published in Japanese on Jul. 1, 2010 as WO 2010/073967 A1 under PCT Article 21(2). All of these applications are herein incorporated by reference.

BACKGROUND OF THE INVENTION

1. Field of the Invention

The present invention relates to a pin fastener. More particularly, the invention relates to a pin fastener for fastening a pin provided on a personal ornament or the like. The invention is preferably applied to a pinning device for an ornament such as a tie tack, a pin brooch, an earring, or a necklace, but is also applied to a pinning device for any kind of article with a comparatively small size other than an ornament.

2. Description of the Related Art

Many of recent pin fasteners have a structure in which an advancement and withdrawal of a fastening member with respect to a pin are carried out by utilizing a spring material having an elastic deformation function. As a normal pin fastener is of a small size, it is practical to simplify the structure of the fastener with a pin fastening mechanism utilizing the spring material.

For example, a pin fastener shown in cross-section in FIGS. 1(*a*) and 1(*b*) is proposed as a first related art. In the pin fastener 1, a pair of fastening members 3 made of an elastically deformable material are housed inside a cover 2 with a circular or ellipsoidal form as a whole. The fastening members 3 are configured so as to be symmetrical with a central pin insertion portion 4 as a center, and each of them includes a pin fastening arm 5 and a holding arm 6, each of which has the form shown in the drawing.

In a condition in which a pin is fastened, as shown in FIG. 1(*a*) , the holding arm 6 of one of the two fastening members 3 presses the other fastening member 3 in an opposite direction, as a result of which the pair of pin fastening arms 5 are pressed in the direction of the pin insertion portion 4. For this reason, the pin (not shown) in the pin insertion portion 4 is fastened by the pair of pin fastening arms 5.

When the pin is withdrawn from the pin fastener 1, button portions 7 projecting outside the cover 2 from the fastening members 3 are depressed in the direction of the center. Then, as shown in FIG. 1(*b*) , each of the pair of pin fastening arms 5 withdraws from the pin against the biasing force of the holding arm 6, and the condition in which the pin is fastened is terminated.

Next, a personal ornament fastener described in the following Patent Literature 1 is illustrated as a second related art.

[Patent Literature 1] JP-A-2008-394

The fastener is such that, although not shown, firstly, a guide cylinder on the inside wall surface of which a tapered portion is formed is provided in a housing having a pin insertion opening. Then, a spherical body pressing member which has a plurality of spherical bodies and a flange member whose lower surface makes contact with the spherical bodies, and is constantly biased in the direction of the pin insertion opening by an elastic body, is disposed in the inside space of the guide cylinder. As a result of this, a configuration is such that the pin is clamped inside a ring formed by the plurality of spherical bodies ma predetermined internal position of the tapered portion.

However, a pin fastener of a personal ornament or the like is generally of a very small size. Therefore, The first related art shown in FIG. 1 and the second related art exemplified as Patent Literature 1 both have an intricate structure, and moreover, it is not easy with them to manufacture or assemble parts.

That is, with the first related art, the pair of fastening members 3 include the pin fastening arms 5 and holding arms 6 with an intricately bent form, and it is not easy to accurately manufacture these kinds of intricately formed fastening member 3 to a microscopic size. Also, with the second related art, it is not easy to provide the guide cylinder haying the tapered portion on its inside wall surface in the minute housing, or dispose the plurality of spherical bodies, flange member, elastic body (a coil spring), and the like, in the inside space of the guide cylinder, both in terms of manufacturing the parts and in terms of assembling the parts. Consequently, in the cases of these pin fasteners, manufacturing cost and assembly cost are forced upward.

SUMMARY OF THE INVENTION

The invention has an object of providing a pin fastener which has a simple configuration formed of an extremely small number of parts which are easy to manufacture and assemble, and moreover, of which a superior working effect can be expected as a pin fastener.

(First Aspect of the Invention)

A first aspect of the invention of the present application is a pin fastener being configured of a cylindrical body into which a pin is inserted, and a coil spring provided on the outer periphery of the cylindrical body, wherein a groove-like or window-like cut is provided in the vicinity of a front end portion of the cylindrical body which is a pin insertion side end portion, as well as the rear end side end portion of the coil spring being fixed in a rear end side portion of the cylindrical body, a fastening portion extended in such a way as to intersect radially with the circumferential line of the coil spring is formed at the front end portion of the coil spring (the fastening portion may be formed in a straight line, or may be formed in a slightly curved line), and the fastening portion is fitted into the cut of the cylindrical body, thereby forming a pin fastening narrowed portion between the fastening portion and a wall portion of the cylindrical body opposed thereto, the pin fastener being characterized by including the configuration of (1) or (2) described below:

(1) As well as the cut of the cylindrical body being provided in an oblique direction from the rear end side toward the front end side of the cylindrical body, the coil spring is provided in a condition in which it is axially compressed.

(2) The coil spring is provided in a condition in which it is in close contact or in approximately close contact with the outer periphery of the cylindrical body.

The pin fastener according to the first aspect of the invention is configured of the cylindrical body into which the pin is inserted and the coil spring provided on the outer periphery of the cylindrical body, meaning that the manufacturing cost of parts is significantly reduced. Also, when assembling the pin fastener, it is sufficient simply to fix the rear end side end portion of the coil spring in the cylindrical body, as well as fitting the fastening portion extended in such as way as to intersect radially with the circumferential line of the coil spring, on the front end side of the coil spring, into the cut of the cylindrical body, meaning that the assembly cost of the pin fastener is also significantly reduced.

According to the first aspect of the invention, when the pin is inserted from the front end portion of the cylindrical body which is the pin insertion side end portion, the leading end of the pin pushes up the fastening portion, which is positioned in the pin fastening narrowed portion of the cylindrical body, along the cut against the spring force of the coil spring. Then, after the leading end of the pin has passed through the narrowed portion, the fastening portion is strongly pressed against the pin based on the spring force of the coil spring, meaning that an effective pin fastening is carried out.

The force by which the fastening portion of the coil spring is strongly, pressed against the pin is obtained for the following reasons. That is, in the case of (1) of the first aspect of the invention, the fastening portion of the coil spring in the compressed condition is fitted in the cut provided in the oblique direction from the rear end side toward the front end side of the cylindrical body. Consequently, the coil spring tending to expand in the axial direction is converted into a strong pressing force of the fastening portion against the pin inserted in the narrowed portion owing to the cut provided in the oblique direction. In the case of (2) of the first aspect of the invention, as the coil spring is provided in the condition in which it is in close contact or in approximately close contact with the outer periphery of the cylindrical body, a strong pressing force of the fastening portion based on the unwinding resistance of the coil spring acts on the pin inserted in the narrowed portion.

When the concave portion is provided in the vicinity of the leading end portion of the pin, when the concave portion of the pin reaches the narrowed portion after she leading end of the pin has passed through the narrowed portion, as heretofore described, the fastening portion of the coil spring bites into the concave portion under the spring force, and the pin fastening is more reliably carried out. Meanwhile, when the pin is pulled out from the cylindrical body in the axial direction against the spring force of the fastening portion of the coil spring, the pin fastening can be released by an action the reverse of the heretofore described one.

In this way, it is necessary to carry out the pin fastening and the release thereof against the spring force of the coil spring provided on the outer periphery of the cylindrical body. Consequently, there is no danger of the pin fastening being released against one's will in a normal condition in which one is wearing a personal ornament or the like, except for a case of carrying out the pin fastening and the release thereof by artificially applying a strong operational force.

(Second Aspect of the Invention)

In a second aspect of the invention of the present application, the front end portion of the cylindrical body of the pin fastener according to the first aspect of the invention is expanded in diameter and opened in a trumpet form.

The pin fastener according to the second aspect of the invention is such that the front end portion (pin insertion side end portion) of the cylindrical body is expanded in diameter and opened in a trumpet form, meaning that the operation of inserting the pin into the cylindrical body is easy and reliable. This advantage is particularly great when it is necessary to carry out the pin fastening by blindly operating a personal ornament, or the like, like, for example, an earring worn in the ear.

(Third Aspect of the Invention)

A third aspect of the invention of the present application is a pin fastener being configured of a cylindrical body into which a pin is inserted, a coil spring provided on the outer periphery of the cylindrical body, and an outer cylindrical body surrounding the outer periphery of the coil spring, wherein a groove-like or window-like cut is provided in the vicinity of a front end portion of the cylindrical body which is a pin insertion side end portion, as well as the rear end side end portion of the coil spring being fixed in a rear end side portion of the cylindrical body, a fastening portion extended in such a way as to intersect radially with the circumferential line of the coil spring is formed at the front end portion of the coil spring (the fastening portion may be formed in a straight line, or may be formed in a slightly curved line), and the fastening portion is fitted into the cut of the cylindrical body, thereby forming a pin fastening narrowed portion between the fastening portion and a wall portion of the cylindrical body opposed thereto, and furthermore, wherein a circumferentially grooved window-like opening portion is formed in a portion in the vicinity of the front end portion of the outer cylindrical body and on the side radially opposite to the cut of the cylindrical body, the pin fastener being characterized by including the configuration of (1) or (2) described below:

(1) As well as the cut of the cylindrical body being provided in an oblique direction from the rear end side toward the front end side of the cylindrical body, the coil spring is provided in a condition in which it is axially compressed, all coils, or a front end side coil, of the coil spring are formed to have a large diameter, and one portion of the large diameter coils is fitted in the window-like opening portion of the outer cylindrical body.

(2) A first coil with a diameter larger than that of the other coils is formed on the front end side of the coil spring and, as well as one portion thereof being fitted into the window-like opening portion of the outer cylindrical body, the other coils of the coil spring are provided in a condition in which they are in close contact or in approximately close contact with the outer periphery of the cylindrical body.

With the third aspect of the invention, it is possible to expect the effect of reducing manufacturing cost and assembly cost of parts previously described relating to the first aspect of the invention.

Also, with regard to the effect of pin fastening in the narrowed portion, and the working effect of the operation of releasing the pin fastening, or the like, in the case of (1) of the third aspect of the invention, all the coils, or the front end side coil, of the coil spring are formed to have a large diameter, but it is possible to expect the same advantages as in the case of (1) of the first aspect of the invention. In the case of (2) of the third aspect of the invention, the large diameter first coil is formed on the front end side of the coil spring but, as the other coils are provided in the condition in which they are in close contact or in approximately close contact with the outer periphery of the cylindrical body, it is possible to expect the same advantages as in the case of (2) of the first aspect of the invention.

With the pin fastener according to the third aspect of the invention, it is possible to further expect the following advantages. That is, by providing the outer cylindrical body on the outer periphery of the coil spring, it is possible to make the external appearance of the pin fastener good, and it is easy to carry out a pin fastening and unfastening operation with fingers. Also, as the outer cylindrical body is such that one portion of the large diameter coils of the coil spring is fitted in the window-like opening portion thereof, the outer cylindrical body will not come off in the axial direction. Furthermore, when the pin fastening is released, a coil portion of the coil spring exposed to the window-like opening portion of the outer cylindrical body in a portion on the side opposite to the cut of the cylindrical body is pushed up by a finger, thereby pushing up the fastening portion of the coil spring along the cut, thus disabling the pullout resistance of the pin caused by the spring force. Consequently, it is easier to release the pin fastening. In other words, it is possible to design in such a way that the pullout resistance of the fastening portion of the coil spring (a pin fastening strength) is very strong.

(Fourth Aspect of the Invention)

In a fourth aspect of the invention of the present application, the front end portion of the cylindrical body of the pin fastener according to the third aspect of the invention is expanded in diameter and opened in a trumpet form.

With the pin fastener according to the fourth aspect of the invention, it is possible to obtain the same advantages as in the case of the second aspect of the invention.

(Fifth Aspect of the Invention)

A fifth aspect of the invention of the present application is a pin fastener being configured of a cylindrical body into which a pin is inserted, a coil spring provided on the outer periphery of the cylindrical body, and an outer cylindrical body surrounding the outer periphery of the coil spring, wherein a groove-like or window-like cut is provided in the vicinity of a front end portion of the cylindrical body which is a pin insertion side end portion, as well as the rear end side end portion of the coil spring being fixed in a rear end side portion of the cylindrical body, a fastening portion extended in such a way as to intersect radially with the circumferential line of the coil spring is formed at the front end portion of the coil spring (the fastening portion may be formed in a straight line, or may be formed in a slightly curved line), and the fastening portion is fitted into the cut of the cylindrical body, thereby forming a pin fastening narrowed portion between the fastening portion and a wall portion of the cylindrical body opposed thereto, and furthermore, wherein as well, as an outward flange being formed in the front end portion of the cylindrical body, an inward flange with an opening diameter smaller than that of the outward flange is formed in the front end portion of the outer cylindrical body, the pin fastener being characterized by including the configuration of (1) or (2) described below:

(1) As well as the cut of the cylindrical body being provided in an oblique direction from the rear end side toward the front end side of the cylindrical body, the coil spring is provided in a condition in which it is axially compressed, and all coils, or a front end side coil, of the coil spring are formed to have a diameter larger than the opening diameter of the inward flange of the outer cylindrical body.

(2) A first coil with a diameter larger than the opening diameter of the inward flange of the outer cylindrical, body is formed on the front end side of the coil spring, and the other coils of the coil spring are provided in a condition in which they are in close contact or in approximately close contact with the outer periphery of the cylindrical body.

With the pin fastener according to the fifth aspect of the invention, it is possible to expect the effect of reducing the manufacturing cost and assembly cost of parts previously described relating to the first aspect of the invention.

Also, with regard to the effect of pin fastening in the narrowed portion, and the working effect of the operation of releasing the pin fastening, or the like, in the case of (1) of the fifth aspect of the invention, all the coils, or the front end side coil, of the coil spring are formed to have a diameter larger than the opening diameter of the inward flange of the outer cylindrical body, but it is possible to expect the same advantages as in the case of (1) of the first aspect of the invention. In the case of (2) of the fifth aspect of the invention, the large diameter first coil is formed on the front end side of the coil spring but, as the other coils are provided in the condition in which they are in close contact or in approximately close contact with the outer periphery of the cylindrical body, it is possible to expect the same advantages as in the case of (2) of the first aspect of the invention.

With the pin fastener according to the fifth aspect of the invention, it is possible to further expect the following advantages. That is, by providing the outer cylindrical body on the outer periphery of the coil spring, it is possible to make the external appearance of the pin fastener good, and it is easy to carry out a pin fastening and unfastening operation with fingers. Also, as the inward flange of the outer cylindrical body is engaged between the outward flange in the front end portion of the cylindrical body and the large diameter coil of the coil spring, the outer cylindrical body will not come off in the axial direction. When the inward flange of the outer cylindrical body is engaged in this way, it is possible to cause the inward flange of the outer cylindrical body to advance into the heretofore mentioned engagement position from the rear end side of the cylindrical body while the large diameter coil of the coil spring is elastically reduced in diameter.

(Sixth Aspect of the Invention)

In a sixth aspect of the invention of the present application, the front end portion of the cylindrical body of the pin fastener in which the outward flange is formed according to the fifth aspect of the invention is expanded in diameter and opened in a trumpet form.

With the pin fastener according to the sixth aspect of invention, it is possible to obtain the same advantages as in the case of the second aspect of the invention.

(Seventh Aspect of the Invention)

In a seventh aspect of the invention of the present application, the coil spring according to any one of the first aspect to the sixth aspect of the invention is such that an arm extending in an axial direction of the coil spring is formed at the front end portion thereof, and a fastening portion extended in such a way as to intersect radially with the circumferential line of the coil spring is formed at the leading end of the arm.

With the pin fastener according to the seventh aspect of the invention, as the fastening portion is formed across the arm extending in the axial direction of the coil spring, it is possible to impart a softer elasticity to the fastening portion. As a result of this, the fastening portion is also sufficiently pressed against a pin with a differing thickness, and a good pin fastening effect is achieved.

(Eighth Aspect of the Invention)

An eighth aspect of the invention of the present invention is a pinning device including a pin provided at one chain end portion of a necklace, and a pin fastener provided at the other chain end portion of the necklace in order to fasten the pin, wherein the pin, being made of a metal material adsorbed by a magnet, includes a concave portion in the vicinity of a leading end portion, and the leading end portion formed to be flat or round and, as well as the pin fastener including the configuration described in any one of claims 1 to 7, a magnet which adsorbs the leading end portion of the pin inserted into the cylindrical body is housed inside the cylindrical body.

The pinning device according to the eighth aspect of the invention is such that the pin fastener according to any one of the first aspect to the seventh aspect of the invention is applied to a pinning device for a necklace, and the pin includes the leading end portion formed to be flat or round, meaning that there is no danger to a user. As the pin is made of a metal material adsorbed by a magnet, and a magnet is housed inside the cylindrical body of the pin fastener, it is easy and reliable to insert the pin into the cylindrical body by the pin being attracted and guided by the magnet. Furthermore, the pin inserted in the cylindrical body is adsorbed by the magnet, and the concave portion in the vicinity of the leading end portion of the pin is held by the fastening portion of the coil spring, meaning that a pin fastening force is strong.

(Ninth Aspect of the Invention)

In a ninth aspect of the invention of the present application, according to the pinning device of the eighth aspect of the invention, the rear end side end portion of a coil spring of the pin fastener, as well as being fixed in the cylindrical body, is extended to the central portion of she cylindrical body, forming a magnet stopper, and the magnet is housed inside the cylindrical body in a condition in which it can move slightly between the fastening portion of the coil spring and the magnet stopper.

With the pinning device according to the ninth aspect of the invention, the magnet housed inside the cylindrical body is housed in the condition in which it can move in the axial direction, and a forward movement is restricted by the fastening portion of the coil spring, while a backward movement is restricted by the magnet stopper of the coil spring, meaning that the magnet is housed in the condition in which it can move slightly between the fastening portion of the coil spring and the magnet stopper.

Consequently, when the leading end portion of the pin is inserted into the cylindrical body, the magnet moves to a portion immediately behind the fastening portion of the coil spring, and the attracting and guiding effect of the magnet with respect to the pin is sufficiently achieved. Meanwhile, when the pin is inserted more deeply into the cylindrical body, the magnet moves backward to a position in which it is stopped by the magnet stopper, meaning thou the magnet does not inhibit the insertion of the pin.

DETAILED DESCRIPTION OF THE INVENTION

Figure 1:
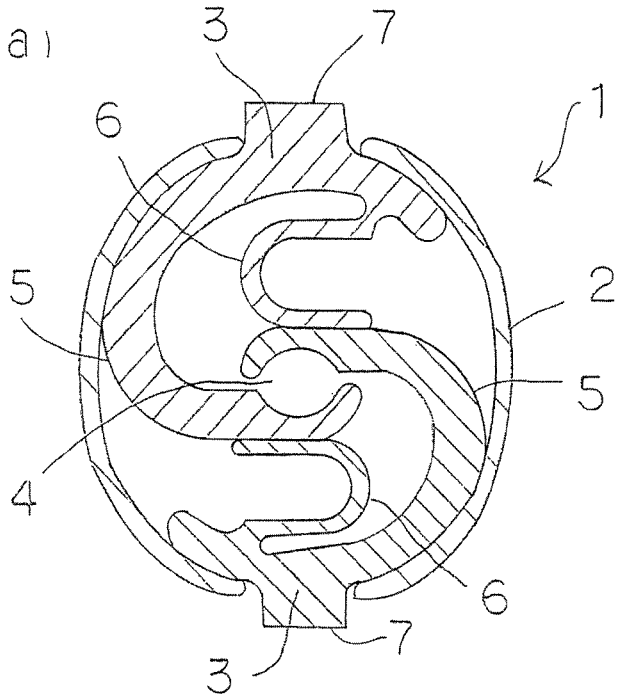
FIG. 1 Prior Art
FIGS. 1(*a*) and 1(*b*) are sectional views showing a heretofore known pin fastening type fastener.
Figure 1:
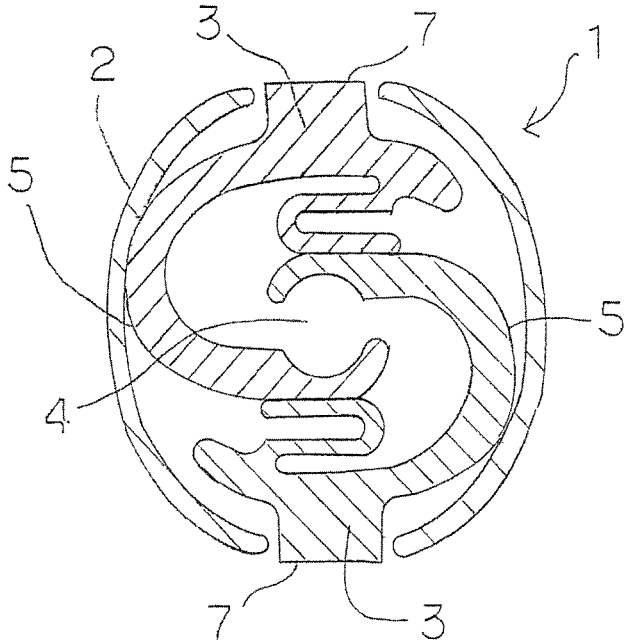
FIG. 1 Prior Art

Next, a description will be given of modes for carrying out the invention, including a best mode therefor.

[Pin Fastener]

A pin fastener according to the invention is mainly a pin fastener for fastening a pin provided on a personal ornament or the like, but is also used for pinning any kind of article other than a personal ornament.

As a "personal ornament or the like", it is possible to exemplify with a personal ornament such as a tie tack, a pin brooch, an earring, or a necklace. With a necklace, a pin (preferably, a pin with a non-pointed form) can be provided at one chain end portion thereof, and a pin fastener provided at the other chain end portion, as shown in a working example to be described hereafter. With these ornaments, for example, it is possible to adopt a method of attaching a pin on the side of an ornament member adorned with a jewel or the like, and fastening the ornament member with a pin fastener.

It is also possible to exemplify with a pin fastener for any kind of article of a comparatively small size other than a personal ornament. For example, with a toy, a daily sundry article, or the like, too, by providing one of the parts thereof with a pin fastener, and another with a pin, it is possible to fasten the one to the other. Furthermore, the pin fastener can also be utilized in order to fasten these articles to a wall surface, a board, or the like, by providing one side with a pin fastener and the other with a pin.

A pin may be such that a concave portion is formed in the vicinity of the leading end portion thereof, but with the pin fastener of the invention, a pin fastening effect can also be expected for a pin without this kind of concave portion. Hereafter, a description will be given of first to fifth embodiments of the pin fastener.

[First Embodiment of Pin Fastener]

A pin fastener according to the first embodiment is configured of a cylindrical body into which a pin is inserted, and a coil spring provided on the outer periphery of the cylindrical body.

The inside diameter of the cylindrical body is made slightly larger than the outside diameter of the pin. A groove-like or window-like cut is provided in the vicinity of a front end portion of the cylindrical body which is a pin insertion side end portion. The coil spring is such that the rear end side end portion thereof is fixed in the cylindrical body in order to carry out an axial positioning relative to the cylindrical body. As a form of this fixing, it is preferable that the rear end side end portion of the coil spring is formed bent in an appropriate form, and fitted into a fixing hole or groove-like opening portion provided in the cylindrical body.

The front end side end portion of the coil spring is made a fastening portion extended in such a way as to intersect radially with the circumferential line of the coil spring. The fastening portion may be formed in a straight line, but may also be formed in a slightly curved line, as will also be shown in a working example no be described hereafter. The fastening portion is more preferably extended in such a way as to intersect radially with an eccentric position relative to the center of the circumferential line of the coil spring, The fastening portion is fitted into The cut of the cylindrical body, thereby forming a pin fastening narrowed portion between the fastening portion and a wall portion of the cylindrical body opposed thereto.

The width of the narrowed portion is in an order of magnitude smaller than the diameter of the pin (when the pin has a concave portion, equal to or smaller than the diameter of the concave portion). It is also conceivable to form the cut deeply in order to increase the inside diameter of the cylindrical body, while sufficiently reducing the width of the narrowed portion, with a view to an ease of pin insertion. However, when wishing to avoid a reduction in strength of the cylindrical body due to the cut being formed deeply, it is also effective to indent a portion of the wall portion of the cylindrical body opposed to the fastening portion toward the inner side. It is also effective that the front end portion of the cylindrical body which is a pin insertion opening is opened in a trumpet form by expanding the diameter thereof, with a view to an ease and reliability of inserting the pin.

With the first embodiment, the configuration of (1) or (2) described below is possible.

(1) As well as she cut of the cylindrical body being provided in an oblique direction from the rear end side toward the front end side of the cylindrical body, the coil spring is provided in a condition in which it is axially compressed. The cut is provided along a plane intersecting diagonally with the central axis of the cylindrical body, and in an oblique direction such that the starting portion of the groove-like or window-like cut is positioned on the rear end side of the cylindrical body, and the leading end portion of the cut is positioned on the front end side of the cylindrical body. It is preferable that the opening width of the cut is in an order of magnitude slightly larger than the thickness of the coil spring, and the inclination angle of the "oblique direction", although not necessarily being limited, is preferably in the order of 30° to 45° relative to the central axis of the cylindrical body. The depth of the cut, although not being limited either, is preferably made a depth such that the width of the narrowed portion is smaller than the diameter of the pin (when the pin has a concave portion, a depth of an order of magnitude equal to or smaller than the diameter of the concave portion).

(2) The coil spring is provided in a condition in which it is in close contact or in approximately close contact with the outer periphery of the cylindrical body. In order to do this, it is preferable to use a coil spring having a coil diameter equal to or smaller than the outside diameter of the cylindrical body.

[Second Embodiment of Pin Fastener]

A pin fastener according to the second embodiment is configured of a cylindrical body into which a pin is inserted, a coil spring provided on the outer periphery of the cylindrical body, and an outer cylindrical body surrounding the outer periphery of the coil spring.

In the second embodiment, the inside diameter of the cylindrical body, the point that a cut is provided in the cylindrical body, the point that, as well as the rear end side end portion of the coil spring being fixed in the cylindrical body, a fastening portion is formed at the front end side end portion of the coil spring and fitted into the cut, the point that a pin fastening narrowed portion is formed between the fastening portion and a wall portion of the cylindrical body opposed thereto, the point that it is effective that the front end portion of the cylindrical body is expanded in diameter and opened in a trumpet form, and the like, are the same as in the case of the first embodiment.

With the second embodiment, the configuration of (1) or (2) described below is possible.

(1) As well as a cut of the cylindrical body being provided in an oblique direction from the rear end side toward the front end side of the cylindrical body, a coil spring is provided in a condition in which it is axially compressed, all coils, or a front end side coil, of the coil spring are formed to have a large diameter, and one portion of the large diameter coils is fitted into a window-like opening portion of the outer cylindrical body. In this (1), the configuration of the cut provided in the oblique direction is the same as in the case of the first embodiment.

(2) A first coil with a diameter larger than that of the other coils is formed on the front end side of the coil spring and, as well as one portion thereof being fitted into the window-like opening portion of the outer cylindrical body, the other coils of the coil spring are provided in a condition in which they are in close contact or in approximately close contact with the outer periphery of the cylindrical body. In order to do this, it is preferable to make the diameter of the coils other than the first coil of the coil spring equal to or smaller than the outside diameter of the cylindrical body. It is sufficient that the circumferentially formed width of the window-like opening portion is of such an extent as to be able to restrain the outer cylindrical body from coming off in the axial direction by fitting thereinto one portion of the first coil of the coil spring, and when the circumferentially formed width is set to be too large, it inhibits the strength of the outer cylindrical body.

As a method of assembling the pin fastener according to the second embodiment, it is possible to firstly mount the coil spring on the cylindrical body, next fit the outer cylindrical body thereover, fit one portion of the large diameter coil of the coil spring into the window-like opening portion of the outer cylindrical portion, and furthermore, fit the fastening portion of the coil, spring into the cut of the cylindrical body. When the front end side of the cylindrical body is expanded in diameter and opened in a trumpet form the outer cylindrical body is fitted over the cylindrical body from she rear end side thereof. It is also possible to adopt a method of firstly fitting the outer cylindrical body over the cylindrical body, and then mounting the coil spring between the two.

[Third Embodiment of Pin Fastener]

A pin fastener according to the third embodiment is configured of a cylindrical body into which a pin is inserted, a coil spring provided on the outer periphery of the cylindrical body, and an cuter cylindrical body surrounding the outer periphery of the coil spring.

In the third embodiment, the inside diameter of the cylindrical body, the point that a cut is provided in the cylindrical, body, the point that, as well as the rear end side end portion of the coil spring being fixed in the cylindrical body, a fastening portion is formed at the front end side end portion of the coil spring, and fitted into the cut, the point that a pin fastening narrowed portion is formed between the fastening portion and a wall portion of the cylindrical body opposed thereto, the point that it is effective that the front end portion of the cylindrical body is expanded in diameter and opened in a trumpet form, and the like, are the same as in the case of the first embodiment.

With the third embodiment, the configuration of (1) or (2) described below is possible.

(1) As well as the cut of the cylindrical body being provided in an oblique direction from the rear end side toward the front end side of the cylindrical body, the coil spring is provided in a condition in which it is axially compressed, and all coils, or a front end side coil, the coil spring are formed to have a diameter larger than the opening diameter of an inward flange of the outer cylindrical body. In this (1), the configuration of the cut provided in the oblique direction is the same as in the case of (1) of the first embodiment.

(2) A first coil with a diameter larger than the opening diameter of the inward flange of the outer cylindrical body is formed on the front end side of the coil spring, and the other coils of the coil spring are provided in a condition in which they are in close contact or in approximately close contact with the outer periphery of the cylindrical body. In order to do this, it is preferable to make the diameter of the coils other than the first coil of the coil spring equal to or smaller than the outside diameter of the cylindrical In the third embodiment, the kind of window-like opening portion in the second embodiment is not formed in the outer cylindrical body. Then, the front end side large diameter coil of the coil, spring is formed not in order to fit it into the window-like opening portion of the outer cylindrical body, but in order to engage the inward flange of the outer cylindrical body between the first coil and an outward flange of the cylindrical body.

A method of assembling the pin fastener according to the third embodiment is the same as that in the case of the second embodiment, except that "one portion of the first coil of the coil spring is fitted into the window-like opening portion of the outer cylindrical body."

[Fourth Embodiment of Pin Fastener]

In a pin fastener according to the fourth embodiment, an arm extending in an axial direction of a coil spring is formed at the front end side end portion of the coil spring, and a fastening portion is formed extended from the leading end of the arm in such a way that the fastening portion intersects radially with the circumferential line of the coil spring, in the same way as in the cases of the first to third embodiments. By providing the arm at the front end side end portion of the coil spring, it is possible to impart a softer elasticity to the fastening portion. In other points, the configurations are the same as those of the coil springs according to the first to third embodiments.

[Embodiment of Pinning Device]

A pinning device of the invention is a pinning device configured of a pin provided at one chain end portion of a necklace, and a pin fastener provided at the other chain end portion of the necklace in order to fasten the pin, wherein the pin, being made of a metal material adsorbed by a magnet, includes a concave portion in the leading end vicinity and a leading end formed to be fiat or round and, as well as the pin fastener including the configuration described in any one of the heretofore described embodiments, a magnet which adsorbs the leading end of the pin inserted in a cylindrical body is housed inside the cylindrical body.

The magnet inside the cylindrical body may be housed in a fixed form, but is more preferably housed in a condition in which it can move slightly inside the cylindrical body, as will be described hereafter. When the magnet is fixed inside the cylindrical body, the form of fixing the magnet is not limited unless it inhibits the behavior of the fastening portion of the coil spring of the pin fastener moving along a cut, or the action of the fastening portion holding she concave portion of the pin. For example, it is possible to load a columnar magnet, whose size approximately coincides with the inside diameter of the cylindrical body, into the inside of the cylindrical body, or attach a ring-like magnet to an inner peripheral portion of the cylindrical body. Although means with which a magnet is fixed is not limited, for example, it is possible to bond the magnet to an inner peripheral portion of the cylindrical body using an adhesive. As a position in which a magnet is fixed inside the cylindrical body, it is preferable to fix the magnet in a position in which the leading end of the pin makes exact contact with the magnet in a condition in which the pin is inserted in a correct insertion position.

As a more preferred embodiment, the rear end side end portion of the coil spring of the pin fastener, as well as being fixed in the cylindrical body, is extended to the central portion of the cylindrical body, thus forming a magnet stopper, wherein a magnet can be housed inside the cylindrical body in a condition in which it can move slightly between the fastening portion of the coil spring and the magnet stopper. In this case, it is preferable to provide the magnet stopper on the rear end side of the coil spring in such a way that the magnet abuts exactly against the magnet stopper in a condition in which the pin is inserted in a correct insertion position (in a condition in which the fastening portion of the coil spring bites into the concave portion).

EXAMPLES

Next, a description will be given of working examples of the invention. The technical scope of the invention is not limited by the following working examples.

Example 1

Figure 5:
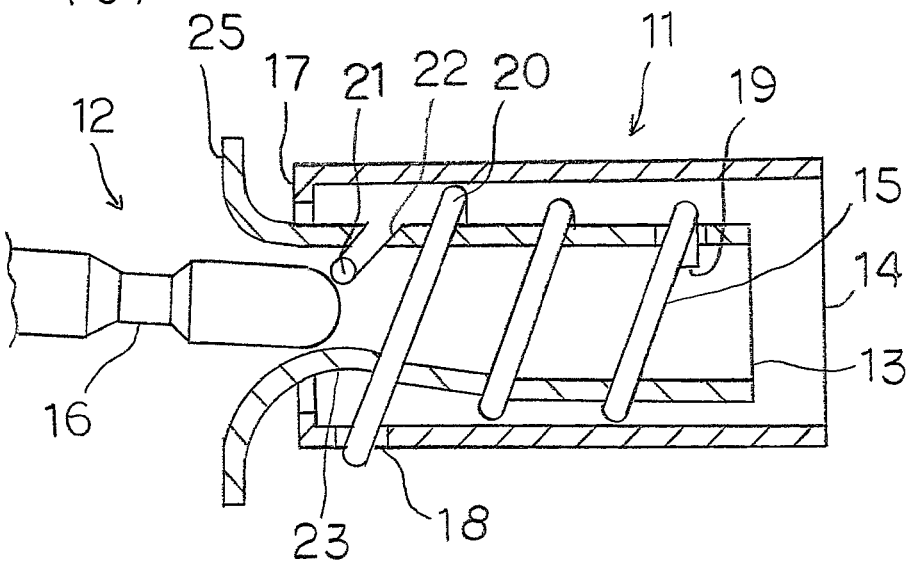
FIGS. 5(*a*) and 5(*b*) are diagrams showing a use condition of the pin fastener of Working Example 1, showing the outer cylindrical, body and cylindrical body in cross-section.
Figure 5:
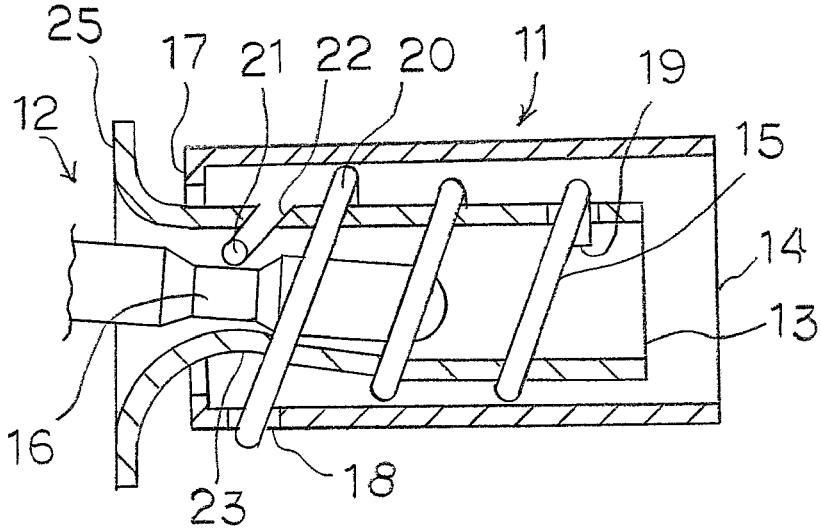

As shown in FIG. 5(*a*), a pin fastener 11 of this working example is configured of a cylindrical body 13 into which a pin 12 is inserted, an outer cylindrical body 14 surrounding the outer periphery of the cylindrical body 13 with a certain idle space left therebetween, and a coil spring 15 which, being provided in the idle space between the cylindrical body 13 and outer cylindrical body 14, is wound in a condition in which it is in close contact or in approximately close contact with the outer periphery of the cylindrical body 13. When using the coil spring 15 with a coil diameter smaller than the outside diameter of the cylindrical body 13, a condition is attained in which the coil spring 15 is wound in a condition in which it is in close contact or in approximately close contact with the outer periphery of the cylindrical body 13. However, when the coil spring 15 is provided in a condition in which it is axially compressed, the coil spring 15 does not have to be in the condition in which it in close contact or in approximately close contact with the outer periphery of the cylindrical body 13.

The pin 12 is provided in a personal ornament (not shown) such as a tie tack, a pin brooch, an earring, or a necklace, and a concave portion 16 with a smaller diameter is formed in the vicinity of the leading end of the pin 12. The pin 12 does not necessarily have to include the concave portion 16.

Figure 2:
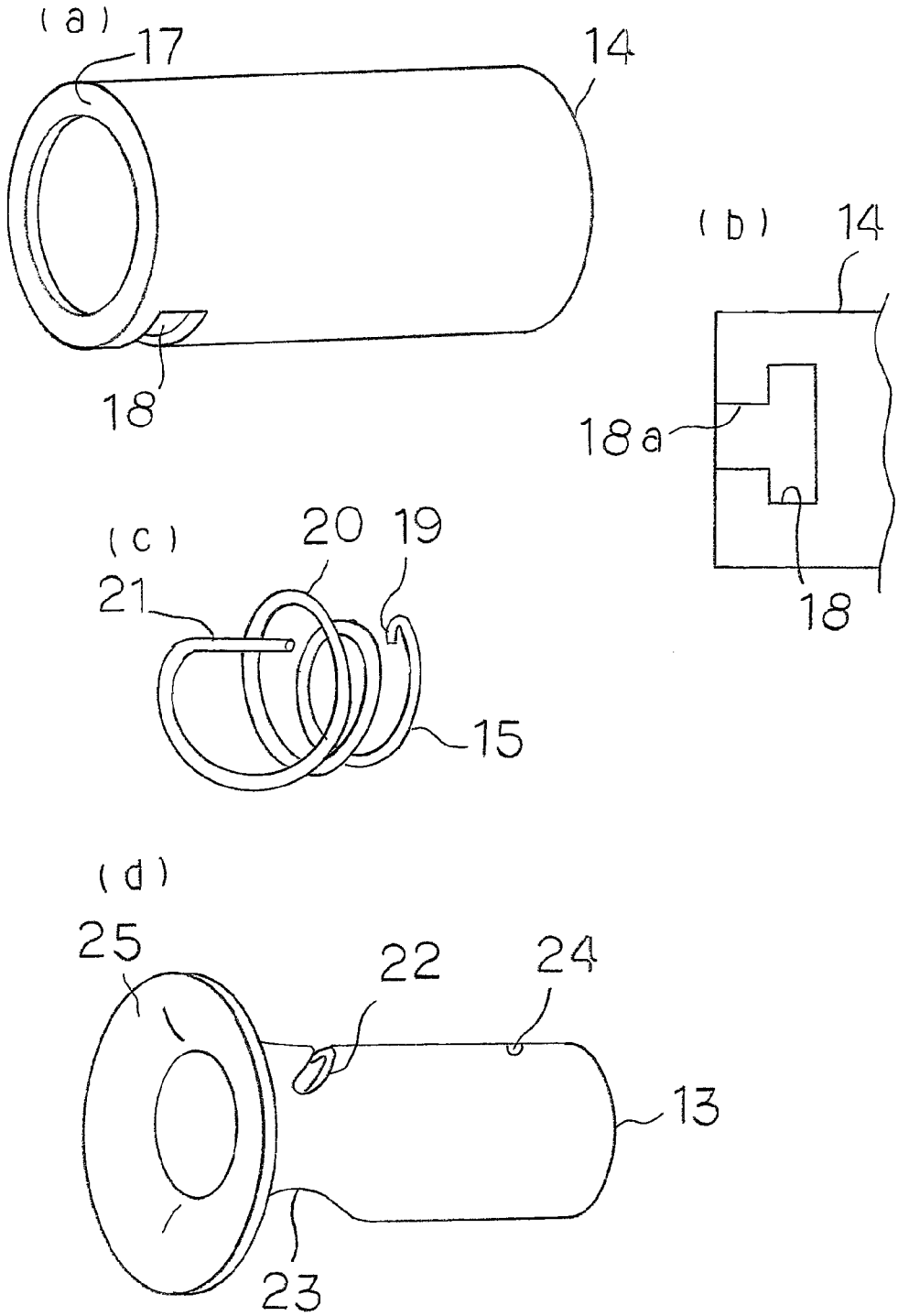
FIG. 2 shows each of component parts of a pin fastener of Working Example 1, wherein FIG. 2(*a*) is a perspective view of an outer cylindrical body, FIG. 2(*b*) is a bottom view of an outer cylindrical body showing a modification working example of a window-like opening portion, FIG. 2(*c*) is a perspective view of a coil spring, and FIG. 2(*d*) is a perspective view of a cylindrical body.

Next, a description will be given, based on FIGS. 2 to 4, of the outer cylindrical body 14, coil spring 15, and cylindrical body 13 in order. The outer cylindrical body 14 shown in FIGS. 2(*a*) and 2(*b*) and FIG. 3(*a*) has an inward flange 17 formed in an opening portion on the front end side thereof, but the flange 17 may be omitted. Also, a window-like opening portion 18 circumferentially grooved with a certain length is formed in the vicinity of the front end portion of the outer cylindrical body 14. The axial width of the window-like opening portion 18 is sufficiently larger than the thickness of the coil spring 15. As shown in FIG. 2(*b*) , the window-like opening portion 18 may be provided with a guidance opening portion 18*a* which is an opening portion reaching the front end of the outer cylindrical body 14. A process of cutting away the window-like opening portion 18 becomes easier by providing the guidance opening portion 18.

The coil spring FIG. 2(*c*) is such that a wire-like spring material is molded into a coil form, but a fixed portion 19, which is a small bend, is formed at the rear end portion of the coil spring 15, a first coil 20 with a diameter larger than that of the other coils is formed in the front end side portion of the coil spring 15, and a linear fastening portion 21 with a form such that it intersects radially with an eccentric position relative to the center of the circumferential line of the coil, spring 15 is formed at the front end portion of the first coil 20. The fastening portion 21 of the coil spring 15 does not necessarily have to be formed in a straight line, and may have, for example, a form such that it intersects radially with the eccentric position relative to the center of the circumferential line of the coil spring 15 while being slightly curved, as shown in FIG. 4(*a*)

Figure 3:
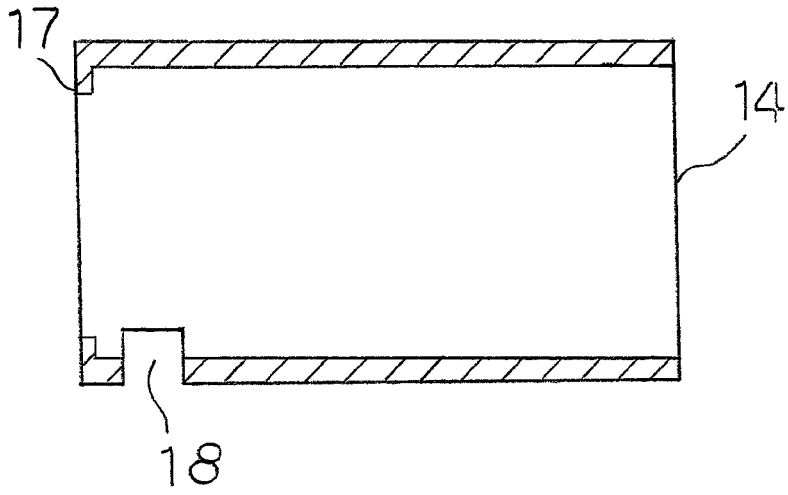
FIG. 3(*a*) is an axial central longitudinal sectional view of the outer cylindrical body shown in FIG. 2(*a*), and FIG. 3(*b*) is an axial central longitudinal sectional view of the cylindrical body shown in FIG. 2(*d*).
Figure 3:
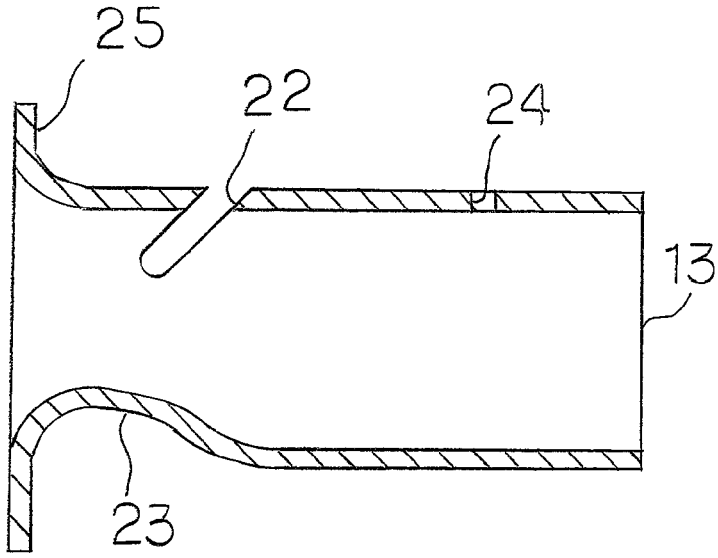
Figure 4:
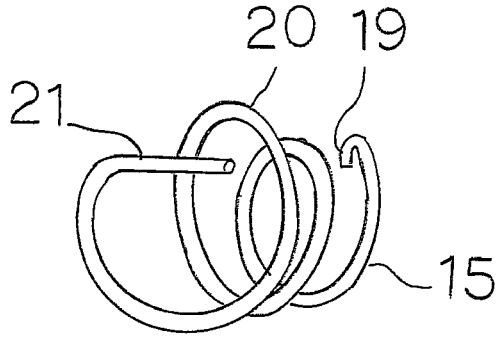
FIG. 4(*a*) is a diagram showing a modification working example of the coil spring, and FIG. 4(*b*) is a diagram showing a modification working example of the cylindrical body.
Figure 4:
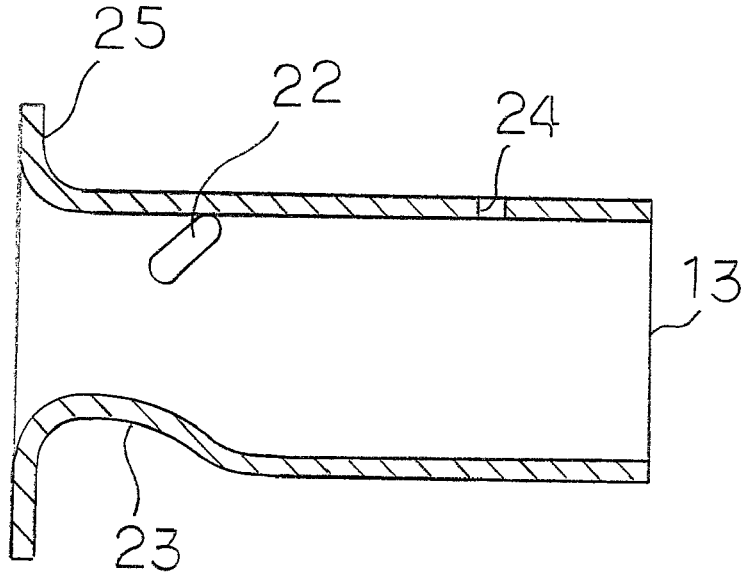

Next, the cylindrical body 13 shown in FIG. 2(*d*) and FIG. 3(*b*) is such that the inside diameter thereof is slightly larger than the outside diameter of the pin 12. A cut 22 made by cutting a peripheral wall portion of the cylindrical body 13 in an oblique direction from the rear end side toward the front end side is provided in a groove form in the vicinity of the front end portion of the cylindrical body 13 which is an insertion side end portion of the pin 12. The cut 22 may be provided in a window form in which the upper end of the cut is not opened to the exterior, as shown in FIG. 4(*b*), rather than in a groove form in which the upper end of the cut is opened to the exterior. When the cut 22 is formed in the groove form, the fastening portion 21 of the coil spring 15 is fitted into the cut 22 from above. When the cut 22 is formed in the window form, the fastening portion 21 of the coil, spring 15 is fitted into the cut 22 in such a way as to be inserted thereinto starting from the leading end portion of the fastening portion 21. The width of the cut 22 is slightly greater than the thickness of the coil spring 15. Also, the cutting direction of the cut 22 is an oblique direction in the order of 30° to 45° with respect to the central axis of the cylindrical body 13. The cutting depth of the cut 22 is designed in such a way that the width of a narrowed portion to be described hereafter is sufficiently smaller than the thickness of the pin 12, or when the pin 12 has the concave portion 16, is designed in such a way that the width of the narrowed portion is approximately equal to or slightly smaller than the thickness of the concave portion 16 of the pin 12. The "narrowed portion" is a space between the leading end of the cut 22 and a radially opposite side wall portion of the cylindrical body 13 opposed thereto. In the working example, when designing the width of this kind of narrowed portion, the wall portion of the cylindrical body 13 is indented inward in a portion corresponding to the narrowed portion, forming a cylinder diameter reduced portion 23 wherein the cylinder diameter of the wall portion is reduced. However, this kind of cylinder diameter reduced portion 23 does not necessarily have to be formed. A fixing hole 24 for inserting the fixed portion 19 of the coil spring 15 is provided in an appropriate portion of the rear end side portion of the cylindrical body 13. Meanwhile, the front end portion of the cylindrical body 13 is expanded in diameter and opened in a trumpet form, forming an outward flange 25. The outside diameter of this kind of outward flange 25 is sufficiently larger than the inside diameter of the outer cylindrical body 14.

Next, a description will be given, based on FIG. 5(*a*) , of an assembly condition of the pin fastener 11 of the working example. As an assembly procedure, firstly, the coil spring 15 is wound around the cylindrical, body 13 and, as well as the fixed portion 19 of the coil spring 15 being inserted into the fixing hole 24 of the cylindrical body 13, the fastening portion 21 of the coil spring 15 is fitted into the cut 22 of the cylindrical body 13, thereby mounting the coil spring 15 on the cylindrical body 13. Next, while the first coil 20 of the coil spring 15 is elastically reduced in diameter, the outer cylindrical body 14 is fitted over the outer circumference the first coil 20, and one portion of the first coil 20 of the coil spring 15 is fitted into the window-like opening portion 18 of the outer cylindrical body 14. When the front end portion of the cylindrical body 13 is expanded in diameter and opened in a trumpet form, the outer cylindrical body 14 is fitted over the cylindrical body 13 from the rear end side (the right side of FIG. 5) thereof.

Next, a description will be given, based on FIGS. 5(*a*) and 5(*b*), of a use condition of the pin fastener 11 of the working example. When the pin 12 is inserted from the front end portion of the cylindrical body 13 expanded in diameter and opened in a trumpet form, the leading end of the pin 12 presses the fastening portion 21 of the coil spring 15 positioned in the pin fastening narrowed portion of the cylindrical body 13, and pushes the fastening portion 21 obliquely upward in the drawing along the cut 22 against the spring force of the coil spring 15. When the leading end of the pin 12 passes through the narrowed portion in this way, and next, the concave portion 16 of the pin 12 reaches the narrowed portion, the fastening portion 21 of the coil spring 15 bites into the concave portion 16 under the spring force, thus carrying out a pin fastening. Even when the pin 12 does not include the concave portion 16, the fastening portion 21 is strongly pressed against the pin 12 by the spring force, meaning that it is possible co obtain a sufficient pin fastening effect. Meanwhile, when the pin 12 is pulled out from the cylindrical body 13 against the spring force of the fastening portion 21 of the coil spring 15, the pin fastening is released by an action the reverse of the heretofore described one.

Example 2

Figure 6:
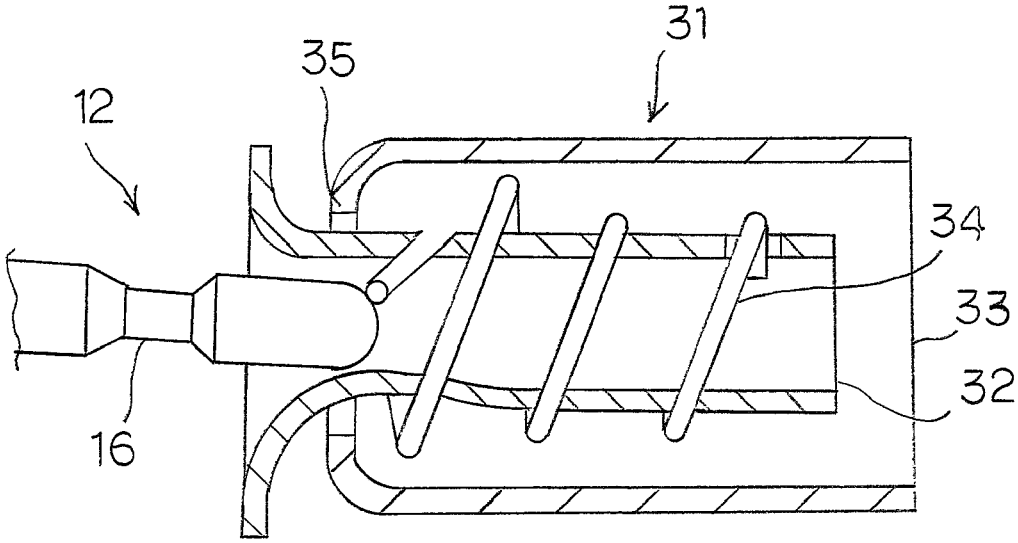
FIG. 6 is a diagram showing a use condition of a pin fastener of Working Example 2, showing an outer cylindrical body and a cylindrical body in cross-section.

As shown in FIG. 6, a pin fastener 31 of this working example is configured of a cylindrical body 32 into which is inserted a pin 12 having the same configuration as in the case of Working Example 1, an outer cylindrical body 33 surrounding the outer periphery of the cylindrical body 32 with a certain idle space left therebetween, and a coil spring 34 which, being provided in the idle space between the cylindrical body 32 and outer cylindrical body 33, is wound in a condition in which it is in close contact or in approximately close contact with the outer periphery of the cylindrical body 32. However, when the coil spring 34 is provided in a condition in which it is radially compressed, the coil spring 34 does not have to be in the condition in which it is in close contact or in approximately close contact with the outer periphery of the cylindrical body 32.

The outer cylindrical body 33 has an inward flange 35 formed in an opening portion of the front end portion thereof. Unlike the outer cylindrical body 14 in Working Example 1, the outer cylindrical body 33 has no grooved window-like opening portion formed in the vicinity of the front end portion thereof The configurations of the cylindrical body 32 and coil spring 34 are the same as in the case of the cylindrical body 13 and coil spring 15 in Working Example 1. However, the large diameter first coil provided in the coil spring 34 functions as means which engages with the inward flange 35 of the outer cylindrical body 33.

Next, a description will be given of an assembly condition of the pin fastener 31 of the working example. As an assembly procedure, firstly, the coil spring 34 is mounted on the cylindrical body 32 by an operation the same as in the case of Working Example 1. Next, while the first coil of the coil spring 34 is elastically reduced in diameter, the outer cylindrical body 33 is fitted over the outer periphery of the first coil from the right side of the drawing, and the flange 35 of the outer cylindrical body 33 is engaged between the outward flange of the cylindrical body 32 and the first coil of the coil spring 34.

A use condition of the pin fastener 31 of the working example is the same as in the case of Working Example 1.

Example 3

Although not shown, a pin fastener of this working example differs from the pin fastener 11 according to Working Example 1 firstly in that it does not have the outer cylindrical body 14. Secondly, it differs in that the coil spring 15 includes the fastening 21, but does not need the large diameter first coil 20, and it is sufficient that it is a coil spring wound all around in a condition in which it is in close contact or in approximately close contact with the outer periphery of the cylindrical body 13. Also, when the coil spring 15 is provided in a condition in which it is axially compressed, the coil spring 15 does not have to be in the condition in which it is in close contact or in approximately close contact with the outer periphery of the cylindrical body 13. Other points are configured in the same way as with the pin fastener 11 according to Working Example 1.

An assembly condition and use condition of the pin fastener of the working example are the same as in the case of Working Example 1, except for the portions relating to the heretofore described differences.

Example 4

Figure 7:
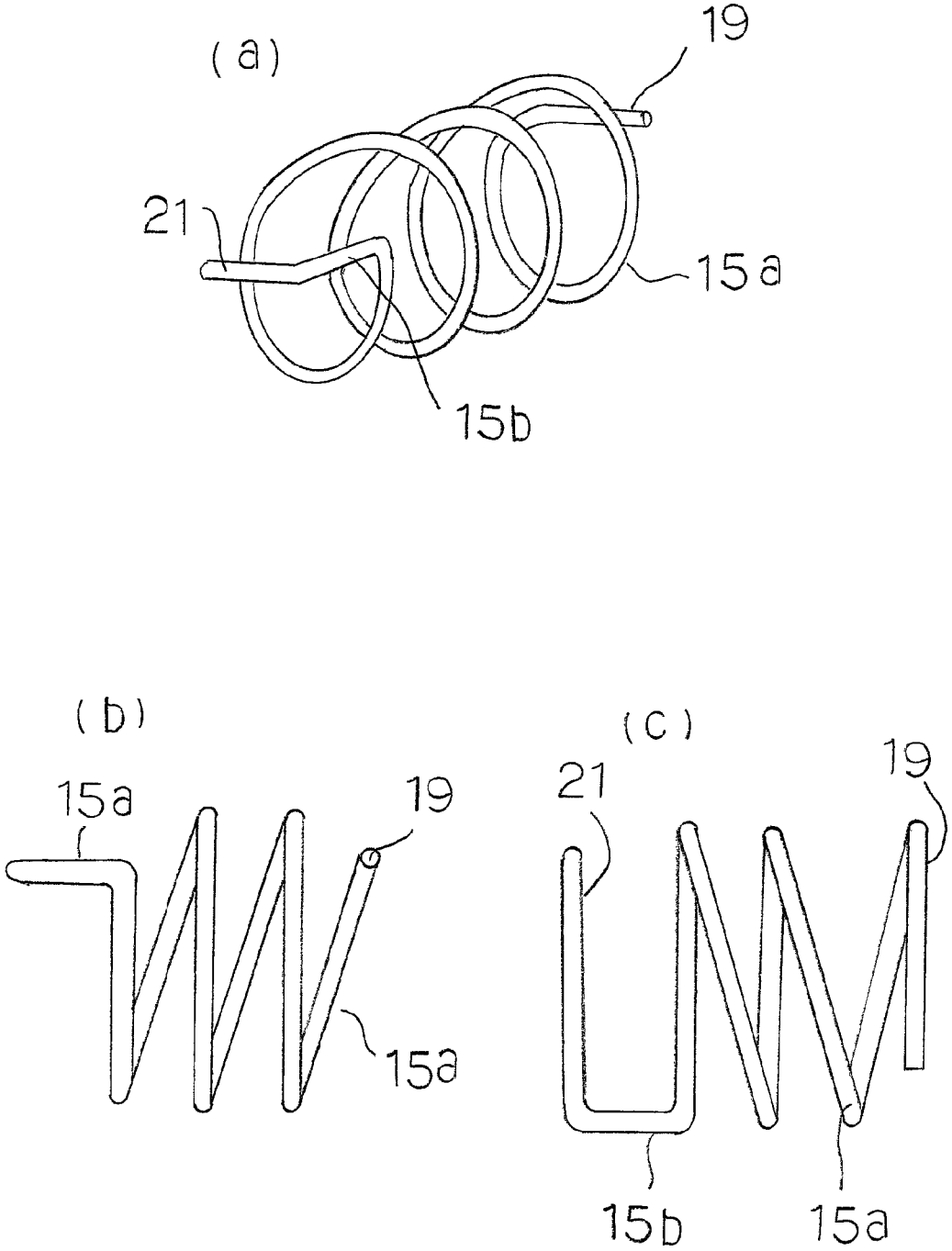
FIG. 7(*a*) shows a perspective view of a coil spring of Working Example 4, FIG. 7(*b*) shows a front view thereof, and FIG. 7(*c*) shows a plan view thereof.

A coil spring 15*a* shown in FIGS. 7(*a*) to 7(*c*) is used in a pin fastener of this working example. The coil spring 15*a* is such that a wire-like spring material is molded into a coil form, wherein a bent fixed portion 19 is formed at the rear end portion of the coil spring 15*a*, an arm 15*b* extending in an axial direction of the coil spring 15*a* is formed in the front end side portion of the coil spring 15*a*, and a fastening portion 21 is formed extended from the leading end of the arm 15*b* in such a way as to intersect radially with the circumferential line of the coil spring 15*a*, in the same way as in the cases of Working Example 1 to Working Example 3.

Figure 8:
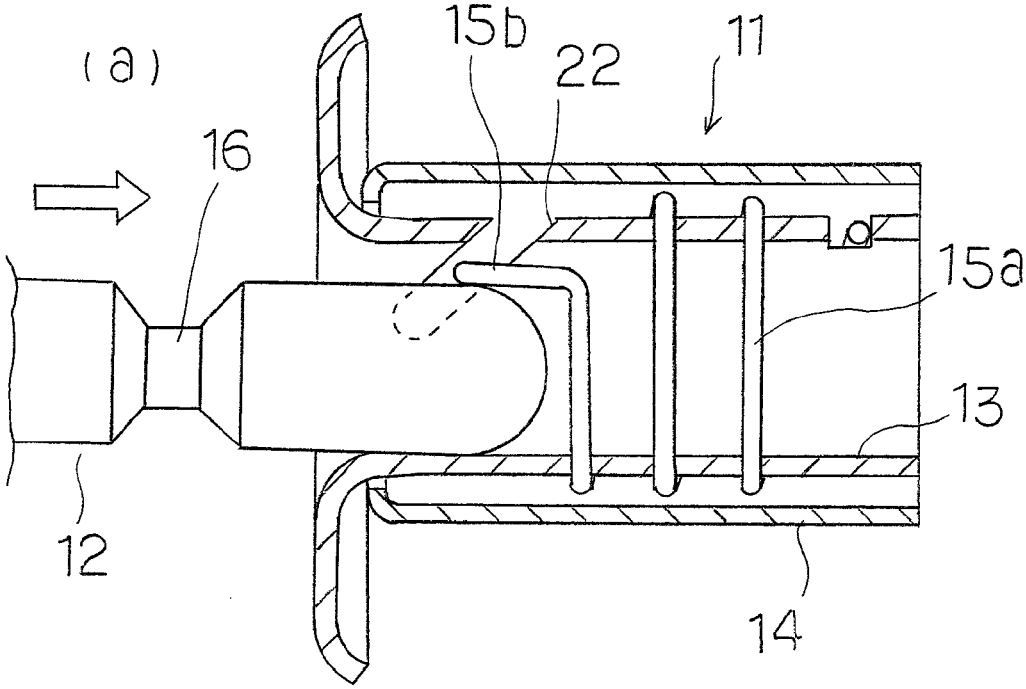
FIGS. 8(*a*) and 8(*b*) are diagrams showing a use condition of a pin fastener using the coil spring according to Working Example 4, showing an outer cylindrical body and a cylindrical body in cross-section.
Figure 8:
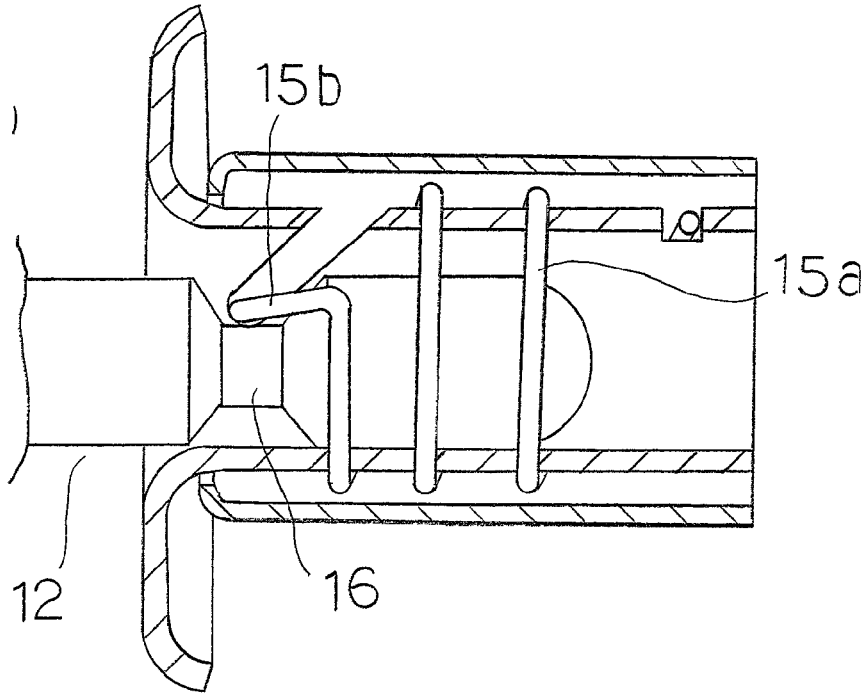

The pin fastener of the working example is shown in FIGS. 8(*a*) and 8(*b*) The pin fastener 11 is configured of a cylindrical body 13 into which a pin 12 is inserted, an outer cylindrical body 14 surrounding the outer periphery of the cylindrical body 13 with a certain idle space left therebetween, and the coil spring 15*a* which, being provided in the idle space between the cylindrical body 13 and outer cylindrical body 14, is wound in a condition in which it is in close contact or in approximately close contact with the outer periphery of the cylindrical body 13. The configuration and assembly condition of each of these members are the same as those of each heretofore described working example, except for the point that the coil spring 15*a* has the heretofore described configuration.

A description will be given of a use condition of the pin fastener 11 of the working example. When the pin 12 is inserted into the cylindrical body 13 from the front end portion thereof expanded in diameter and opened in a trumpet form, the leading end of the pin 12 presses a fastening portion 21 of the coil spring 15*a* positioned in a pin fastening narrowed portion of the cylindrical body 13, and pushes the fastening portion 21 obliquely upward in the drawing along a cut 22 against the spring force of the coil spring 15*a* The fastening portion 21 of the coil spring 15*a*, as it is formed at the leading end of the arm 15*b*, is imparted with a sufficiently soft elasticity. Consequently, even in the event that the pin 12 has a considerable thickness, it is possible to sufficiently push up the fastening portion 21. When the leading end of the pin 12 passes through the narrowed portion in this way, and then, a concave portion 16 of the pin 12 reaches the narrowed portion, the fastening portion 21 of the coil spring 15*a* bites into the concave portion 16 under the spring force, thus carrying out a pin fastening. Meanwhile, when the pin 12 is pulled out from the cylindrical body 13 against the spring force of the fastening portion 21 of the coil spring 15, the pin fastening is released by an action the reverse of the heretofore described one.

Example 5

Figure 9:
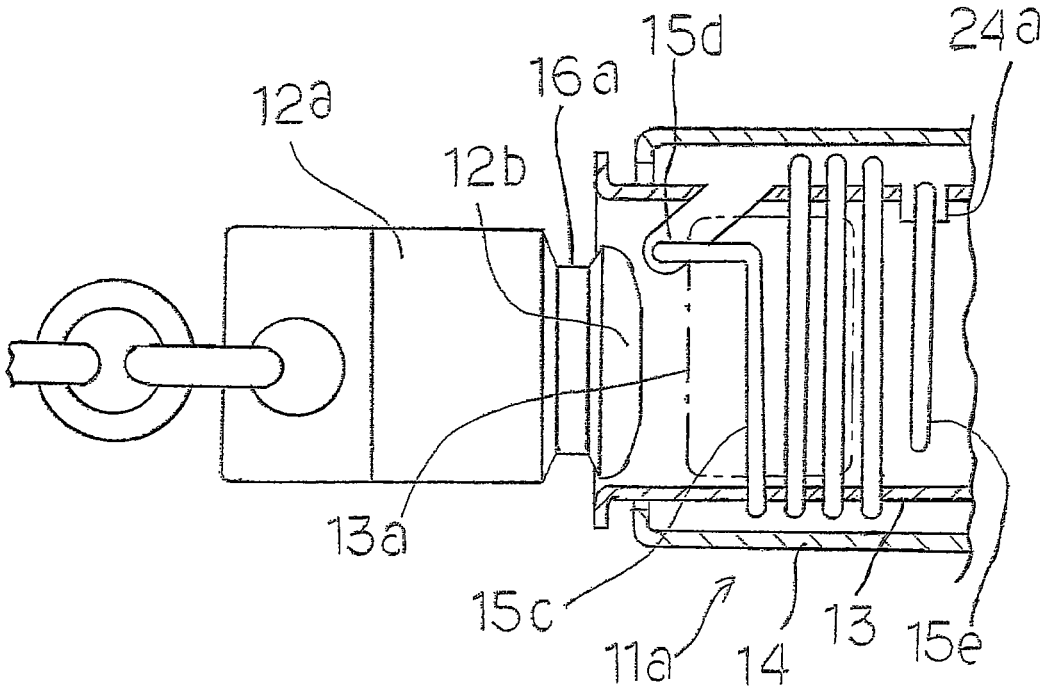
FIG. 9 shows a working example of a pinning device.

As shown in FIG. 9, a pinning device of the invention is configured of a pin 12*a* provided at one chain end portion of a necklace, and a pin fastener 11*a* provided at the other end portion of the necklace in order to fasten the pin 12*a* (one portion of the pin fastener 11*a* is not shown)

The pin 12*a*, being made of a metal material having the nature of being adsorbed by a magnet, includes a leading end portion 12*b* formed to be flat or round, and a concave portion 16*a* in the vicinity of the leading end. Meanwhile, the pin fastener 11*a* is configured of a cylindrical, body 13, an outer cylindrical body 14 surrounding the outer periphery of the cylindrical body 13 with a certain idle space left therebetween, and a coil spring 15*c* which, being provided in the idle space between the cylindrical body 13 and outer cylindrical body 14, is wound in a condition in which it is in close contact or in approximately close contact with the outer periphery of the cylindrical body 13, which are approximately the same as in the case of Working Example4.

A magnet 13*a* (the profile thereof is shown by the dashed-dotted line in the drawing) for adsorbing the leading end portion 12*b* of the pin 12*a* inserted into the cylindrical body 13 is housed inside the cylindrical body 13. The magnet 13*a* is such that a columnar or ring-like magnet having a diameter slightly smaller than the inside diameter of the cylindrical body 13 is housed in the axial direction of the cylindrical body 13.

The coil spring 15*c* is such that an arm 15*d* extending in the axial direction of the coil spring 15*c* is formed in the front end side portion thereof, and a fastening portion (not shown) is formed extended from the leading end of the arm 15*d* in such a way as to intersect radially with the circumferential line of the coil spring 15*c*, in the same way as in the cases of Working Example 1 to Working Example 3. Meanwhile, as well as the rear end side end portion of the coil spring 15*c* being fixed in a groove-like opening portion 24*a* provided in the cylindrical body 13, the leading end of the coil spring 15*c* is extended to the central portion of the cylindrical body 13, forming a magnet stopper 15*e*.

The magnet stopper 15*e* is provided in a position in which the magnet 13*a* abuts exactly against the magnet stopper 15*e* in a condition in which the fastening portion of the coil spring 15*c* bites into the concave portion 16*a* of the pin 12*a*. As a result of this, when the leading end portion 12*b* of the pin 12*a* is inserted into the cylindrical body 13, the magnet 13*a* moves to a portion immediately behind the fastening portion of the coil spring 15*c*, and the action of the magnet 13*a* attracting and guiding the pin 12*a* is sufficiently achieved. Meanwhile, when the pin 12*a* is inserted more deeply into the cylindrical body 13, as the magnet 13*a* moves backward to a position in which it is stopped by the magnet stopper 15*e*, the magnet 13*a* does not inhibit the insertion of the pin 12*a*.

Industrial Applicability

The pin fastener of the invention has a simple configuration formed of an extremely small number of parts which are easy to manufacture and assemble, and moreover, a superior working effect can be expected therefrom as a pin fastener.

What is claimed is:

1. A pin fastener comprising:

a cylindrical body into which a pin is to be inserted; and a coil spring, wherein:

the coil spring is provided on an outer periphery of the cylindrical body, a groove-shaped cut is provided in a front end portion of the cylindrical body which is a pin insertion side end portion, as well as a rear end side end portion of the coil spring being fixed in a rear end side portion of the cylindrical body, a fastening portion extended in such a way as to intersect radially with a circumferential line of the coil spring is formed at a front end portion of the coil spring, and the fastening portion is fitted into the cut of the cylindrical body, thereby forming a pin fastening narrowed portion between the fastening portion and a wall portion of the cylindrical body opposed thereto, and the pin fastener includes configurations of (1) or (2) described below:

(1) as well as the cut of the cylindrical body being provided in an oblique direction from the rear end side portion toward the front end portion of the cylindrical body, the coil spring is provided in a condition in which it is axially compressed; and (2) the coil spring is provided in a condition in which it is in close contact with the outer periphery of the cylindrical body.

2. The pin fastener according to claim 1, wherein the front end portion of the cylindrical body of the pin fastener is expanded in diameter and opened in a trumpet form.

3. The pin fastener according to claim 1, wherein the coil spring is configured such that an arm extending in an axial direction of the coil spring is formed at the front end portion thereof, and the fastening portion is formed at a leading end of the arm.

4. A pinning device including:

a pin provided at one chain end portion of a necklace; and the pin fastener according to claim 1 which is provided at the other chain end portion of the necklace in order to fasten the pin, wherein:

the pin is made of a metal material pulled towards a magnet, and includes a concave portion in a leading end side portion, the leading end side portion is formed to be flat or round and the magnet which pulls the leading end side portion of the pin inserted into the cylindrical body is housed inside the cylindrical body.

5. The pinning device according to claim 4, wherein:

the rear end side end portion of the coil spring of the pin fastener, as well as being fixed in the cylindrical body, is extended to a central portion of the cylindrical body, forming a magnet stopper, and the magnet is housed inside the cylindrical body in a condition in which it can move between the fastening portion of the coil spring and the magnet stopper.

6. A pin fastener comprising:

a cylindrical body into which a pin is to be inserted;

a coil spring; and an outer cylindrical body, wherein:

the coil spring is provided on an outer periphery of the cylindrical body, the outer cylindrical body surrounds an outer periphery of the coil spring, a groove-shaped cut is provided in a front end side portion of the cylindrical body which is a pin insertion side end portion, as well as a rear end side end portion of the coil spring being fixed in a rear end side portion of the cylindrical body, a fastening portion extended in such a way as to intersect radially with a circumferential line of the coil spring is formed at a front end portion of the coil spring, and the fastening portion is fitted into the cut of the cylindrical body, thereby forming a pin fastening narrowed portion between the fastening portion and a wall portion of the cylindrical body opposed thereto, a circumferentially grooved opening portion is formed in a portion in a front end side portion of the outer cylindrical body and on a side radially opposite to the cut of the cylindrical body, and the pin fastener includes configurations of (1) or (2) described below:

(1) as well as the cut of the cylindrical body being provided in an oblique direction from the rear end sideportion toward the front end side portion of the cylindrical body, the coil spring is provided in a condition in which it is axially compressed, all coils or a front end side coil, of the coil spring is formed to have a large diameter, and one portion of large diameter coils is fitted in the opening portion of the outer cylindrical body; and (2) a first coil with a diameter larger than that of the other coils is formed on the front end portion of the coil spring and, as well as one portion thereof being fitted into the opening portion of the outer cylindrical body, the other coils of the coil spring are provided in a condition in which they are in close contact with the outer periphery of the cylindrical body.

7. The pin fastener according to claim 6, wherein the front end side portion of the cylindrical body of the pin fastener is expanded in diameter and opened in a trumpet form.

8. A pin fastener comprising:

a cylindrical body into which a pin is to be inserted;

a coil spring; and an outer cylindrical body, wherein:

the coil spring is provide on an outer periphery of the cylindrical body, and the outer cylindrical body surrounds an outer periphery of the coil spring, a groove-shaped cut is provided in a front end side portion of the cylindrical body which is a pin insertion side end portion, as well as a rear end side end portion of the coil spring being fixed in a rear end side portion of the cylindrical body, a fastening portion extended in such a way as to intersect radially with a circumferential line of the coil spring is formed at a front end portion of the coil spring, and the fastening portion is fitted into the cut of the cylindrical body, thereby forming a pin fastening narrowed portion between the fastening portion and a wall portion of the cylindrical body opposed thereto, as well as an outward flange being formed in the front end side portion of the cylindrical body, an inward flange with an opening diameter smaller than that of the outward flange is formed in a front end portion of the outer cylindrical body, and the pin fastener includes configurations of (1) or (2) described below:

(1) as well as the cut of the cylindrical body being provided in an oblique direction from the rear end side toward the front end side portion of the cylindrical body, the coil spring is provided in a condition in which it is axially compressed, and all coils or a front end side coil, of the coil spring are formed to have a diameter larger than the opening diameter of the inward flange of the outer cylindrical body; and (2) a first coil with a diameter larger than the opening diameter of the inward flange of the outer cylindrical body is formed on the front end portion of the coil spring, and the other coils of the coil spring are provided in a condition in which they are in close contact with the outer periphery of the cylindrical body.

9. The pin fastener according to claim 8, wherein the front end side portion of the cylindrical body of the pin fastener in which the outward flange is formed is expanded in diameter and opened in a trumpet form.

10. The pin fastener according to claim 8, wherein the coil spring is configured such that an arm extending in an axial direction of the coil spring is formed at the front end portion thereof, and the fastening portion is formed at a leading end of the arm.

11. A pinning device including:

a pin provided at one chain end portion of a necklace; and the pin fastener according to claim 8, which is provided at the other chain end portion of the necklace in order to fasten the pin, wherein:

the pin is made of a metal material pulled towards a magnet, and includes a concave portion in a leading end side portion, the leading end side portion is formed to be flat or round and the magnet which pulls the leading end portion of the pin inserted into the cylindrical body is housed inside the cylindrical body.

12. The pinning device according to claim 11, wherein:

the rear end side end portion of the coil spring of the pin fastener, as well as being fixed in the cylindrical body, is extended to a central portion of the cylindrical body, forming a magnet stopper, and the magnet is housed inside the cylindrical body in a condition in which it can move between the fastening portion of the coil spring and the magnet stopper.

* * * * *